US006913444B2

(12) United States Patent
Kariya et al.

(10) Patent No.: US 6,913,444 B2
(45) Date of Patent: Jul. 5, 2005

(54) THIN-FORM CENTRIFUGAL FAN

(75) Inventors: Hirofumi Kariya, Tokyo (JP); Hiroki Yamashita, Tokyo (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 10/389,104

(22) Filed: Mar. 14, 2003

(65) Prior Publication Data

US 2003/0228215 A1 Dec. 11, 2003

(30) Foreign Application Priority Data

Mar. 20, 2002 (JP) ..... 2002-078503

(51) Int. Cl.[7] ..... F04D 17/00
(52) U.S. Cl. ..... 416/185; 415/199.2; 415/199.3
(58) Field of Search ..... 416/182, 185, 416/186 R, 223 B; 415/198.1, 199.1, 199.2, 199.3

(56) References Cited

U.S. PATENT DOCUMENTS 4,666,373 A * 5/1987 Sugiura ..... 416/185
6,210,116 B1 * 4/2001 Kuczaj et al. ..... 416/185

* cited by examiner

*Primary Examiner*—F. Daniel Lopez
*Assistant Examiner*—Richard A. Edgar
(74) *Attorney, Agent, or Firm*—Joel Lutzker, Esq.; Anna Vishev, Esq.; Schulte Roth & Zabel LLP

(57) ABSTRACT

A small, lightweight and inexpensive thin-form centrifugal fan having a first moving blade; a second moving blade; and a stationary blade disposed between the first moving blade and the second moving blade and directing gas taken in by rotation of the first moving blade to the second moving blade. The first and second moving blades are formed such that the rigidity of their central portions is smaller than the rigidity of their outer perimeter areas.

9 Claims, 3 Drawing Sheets

PRIOR ART (a)

PRIOR ART

THIN-FORM CENTRIFUGAL FAN

CROSS-REFERENCE TO RELATED APPLICATIONS

This application claims all rights of priority to Japanese Patent Application Serial No. 2002-078503, filed Mar. 20, 2002 (pending).

1. Field of the Invention

The present invention relates to a thin-form centrifugal fan, specifically a thin form centrifugal fan with lightweight blades, able to be produced at low cost.

2. Background of the Invention

FIG. 2 is a sectional diagram of a conventional thin-form centrifugal fan 1. First and second moving blades 2 are mounted on a rotation shaft 10 so as to face one another on both sides of stationary blades 3 and are able to rotate. The rotation shaft 10 is rotated by a motor 5 connected to the rotation shaft. Spaces 4 and 3*n* are formed in the moving blades 2 and the stationary blades 3, respectfully. Partitions 2*n* are vertically disposed in the moving blades 2 between the circular base portion 2*b* and cover portion 2*a*, which is formed with the same diameter as the circular base portion 2*b*. The stationary blades 3 are formed by casting or other means, and are affixed by screws 7 to a case 6. Case 6 is sealed so that gasses taken in through intake port 8 are exhausted from exhaust port 9.

FIG. 3 shows the structure of the moving blades 2. FIG. 3(*a*) is a front view of the blades, FIG. 3(*b*) is a section through line A—A of FIG. 3(*a*), and FIG. 3(*c*) is an expanded view of portion A in FIG. 3(*b*). On the moving blades 2, partitions 2*n* are vertically disposed between the circular base portion 2*b* and the outer perimeter area of the cover portion 2*a*. Cover portion 2*a* is formed with the same outer diameter as the circular base portion 2*b*, except for the rotation shaft 10 surrounding area (the area within diameter $\phi 1$). Multiple partitions 2*m* are affixed between the cover portion 2*a* and the base portion 2*b* by caulking or other means. When the moving blades 2 rotate, the multiple partitions form the shape of an arc, allowing the gas to easily move from the center of the cover portion 2*a* to the outer surrounding area. As a result, a space 4 is formed between the base portion 2*b* and the cover portion 2*a*. As the moving blades 2 rotate, the gas taken in from the intake port 8 is directed from the center of the cover portion 2*a* toward the outer perimeter. A hole 2*c* is formed at the center of the base portion 2*b* so that the rotation shaft 10 can pass through. The thicknesses of the base portion 2*b* and cover portion 2*a* are uniform. In order to avoid contact between the moving blades 2 and their peripheral parts, for example the stationary blades 3, the rigidity of the moving blades 2 is increased, while the spacing between the moving blades 2 and their peripheral parts is also enlarged.

The operation of the thin-form centrifugal fan 1 is as follows. When the rotation shaft 10 rotates by means of the motor 5, the first and second moving blades 2, which are fixed to the rotation shaft 10, rotate at a specified speed. As the first moving blade 2 turns, the gas taken in along the partitions 2*n* is directed to the outer perimeter and exhausted at the outermost peripheral position on the stationary blade 3. The stationary blade 3 takes in gas from its outermost perimeter and exhausts it to the center of the second moving blade 2. At the second moving blade 2, gas taken in along the partitions 2*n* is directed toward the outer perimeter and is exhausted from the exhaust port 9 in a direction tangential to the rotation circle of the moving blade.

However, the subject thin-form centrifugal fan had the following problems. Since the thickness of the base portion 2*b* and cover portion 2*a* are uniform, in order to avoid contact between the moving blades 2 and their peripheral parts, for example the stationary blades 3, the rigidity of the moving blades 2 has to be increased, while the spacing between the moving blades 2 and their peripheral parts has to be enlarged. As a result, the weight of the moving blades increases, making cost reduction difficult. It is also difficult to reduce the thickness of the thin-form centrifugal fan due to the larger spacing of the peripheral parts.

SUMMARY OF THE INVENTION

The present invention seeks to provide a thin-form centrifugal fan that is small, lightweight, and low cost.

In the presently disclosed and claimed fan design, the thickness of the first and second moving blades is reduced by taking advantage of the effect of the centrifugal force that arises when the moving blades rotate. More specifically, the present thin-form centrifugal fan has a stationary blade which directs gas taken in by the rotation of a first moving blade and directs it to a second moving blade by the rotation thereof from the center of the moving blade to its outer perimeter. The first and second moving blades are formed such that the rigidity in the rotation shaft surrounding area is smaller than the rigidity of the outer perimeter area.

Another embodiment of the invention has the partitions vertically disposed on the thin-form centrifugal fan.

In another embodiment of the invention, the first and second moving blades between a circular base portion are made of a film-shaped metal foil or synthetic resin.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF THE DRAWINGS

The invention is illustrated by way of example and not limitation and the figures of the accompanying drawings in which like references denote like or corresponding parts, and in which:

FIG. 1(*b*) is a section through A—A of FIG. 1(*a*).

FIG. 3(*b*) a section through A—A of FIG. 3(*a*)

FIG. 3(*c*) an expanded view of portion A in FIG. 3(*b*).

DETAILED DESCRIPTION OF THE PREFERRED EMBODIMENTS AND THE DRAWINGS

Figure 1A:
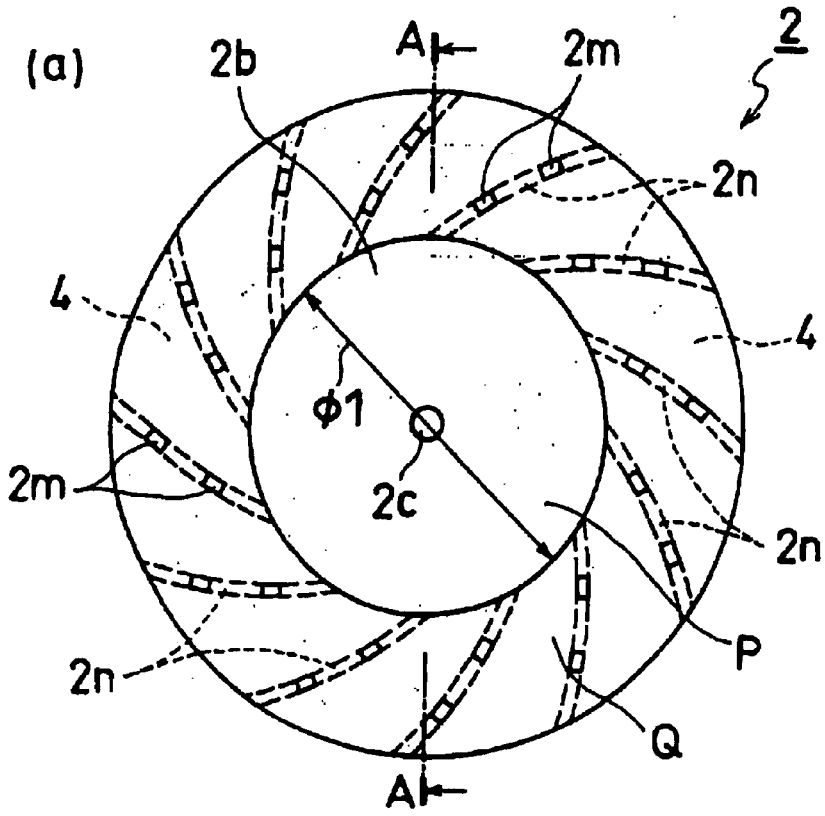
FIG. 1(*a*) is a diagram explaining the structure of the moving blades of the present invention.
Figure 1B:
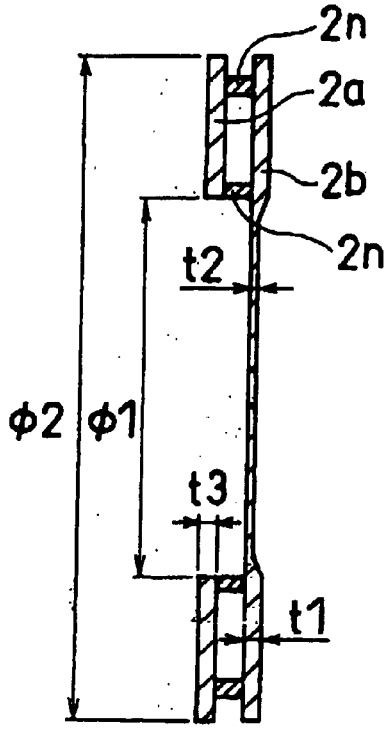
Figure 2:
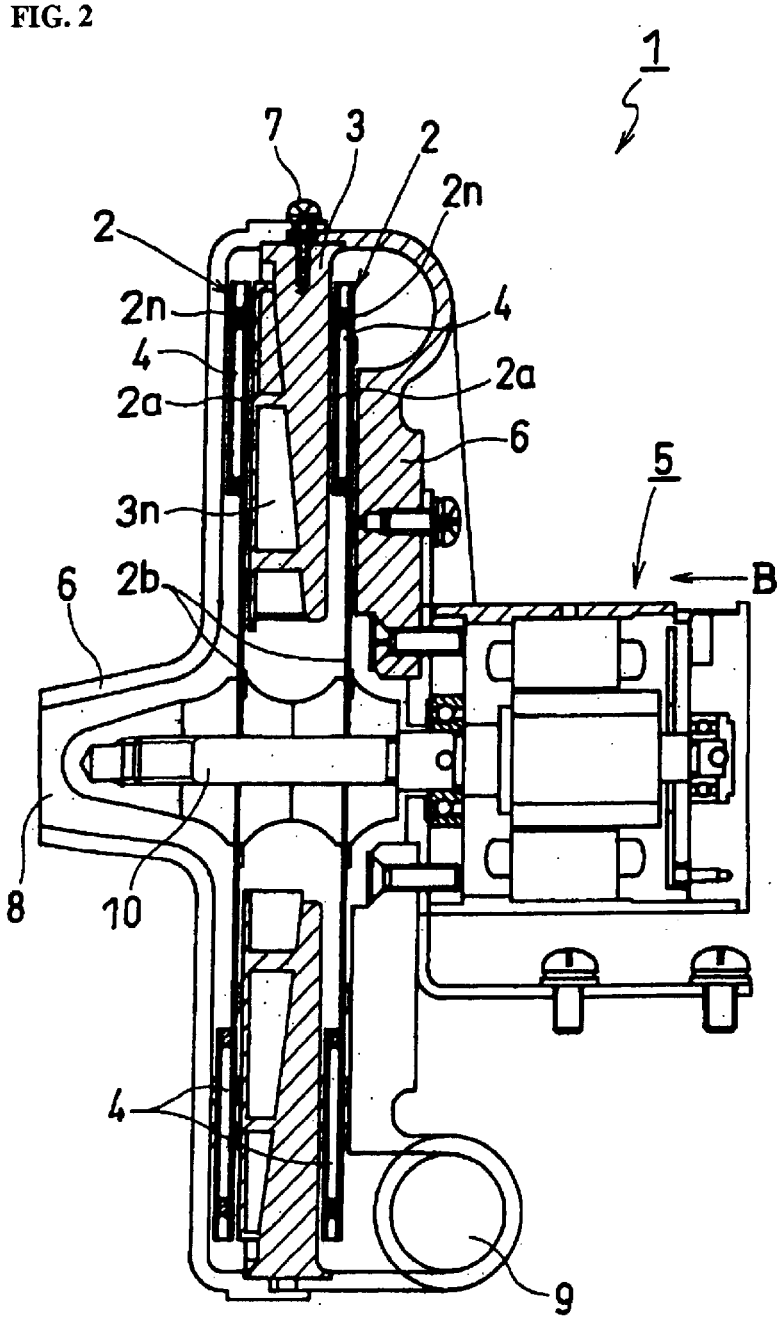
FIG. 2 is a sectional diagram of a conventional thin-form centrifugal fan.
Figure 3A:
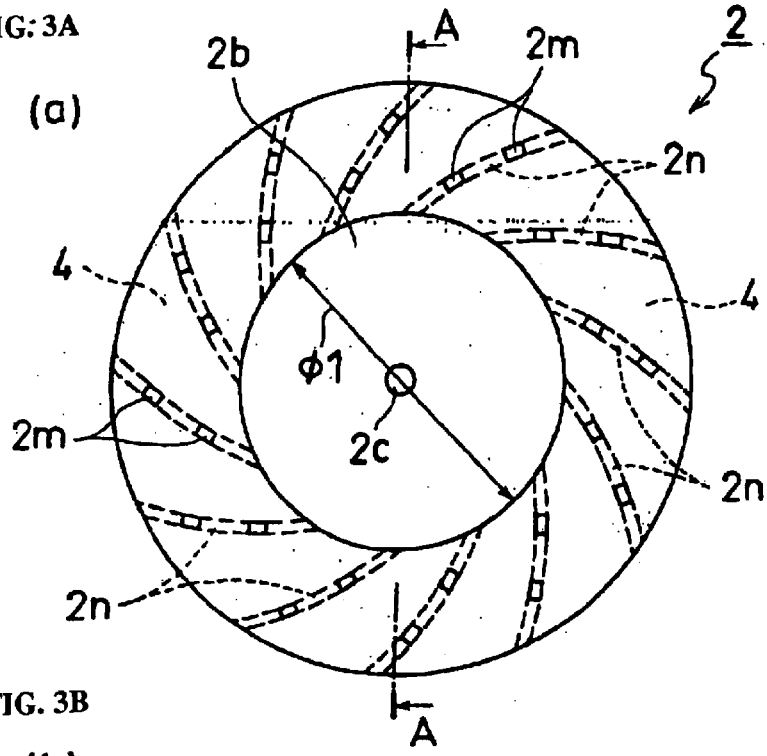
FIG. 3(*a*) is a diagram explaining the structure of the moving blades in FIG. 2
Figure 3B:
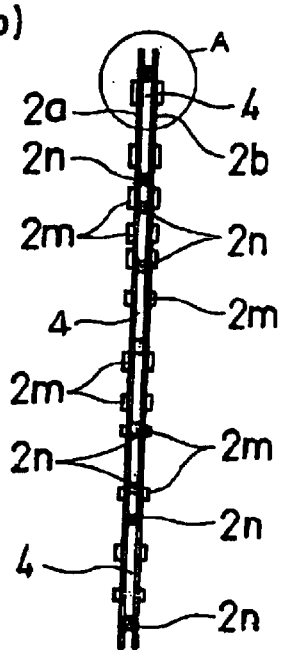
Figure 3C:
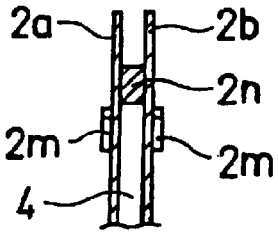

FIG. 1 explains the structure of the moving blade 2 of the present invention, where FIG. 1(*a*) is a front view of the blades, and FIG. 1(*b*) is a section through line A—A of FIG. 1(*a*). The same reference numerals are used for the same parts in FIG. 1 as in FIG. 3, and explanation of those is omitted. The blades shown in FIG. 1 differ from those shown in FIG. 3 in that the rigidity of the base portion 2*b* is not uniform, but rather the rigidity of the area surrounding the rotation shaft 10 (the area within the diameter $\phi 1$, termed "area P" below) is smaller than the rigidity of the outer perimeter thereof (the area between the diameter $\phi 2$ and diameter $\phi 1$, termed area "Q" below).

To accomplish the result of having the area P rigidity to be smaller than the area Q rigidity, the thickness t2 of the area P base portion 2*b* is made thinner than thickness t1 of the area Q base portion 2*b*. As a result, the area Q rigidity is greater than the area P rigidity. The thickness t3 of the cover portion 2*a* is uniform, and partitions 2*n* are disposed between the base portion 2*b* and the cover portion 2*a*, as in FIG. 3. To make the area Q rigidity smaller than the area P rigidity, the base portion 2*b* is made of metal foil or a film-shaped synthetic resin, for example, and the partitions 2*n* vertically placed thereon. That is, the rigidity of area P is reduced by the use of metal film or film-shaped synthetic resin, and the rigidity of area Q is increased by disposing partitions 2*n* between the base portion 2*b* and the cover portion 2*a*.

Operation of the moving blade 2 in FIG. 1 is described below. Centrifugal force takes effect on the moving blade 2 when it is rotated. A radial pulling force works on the cover portion base portion 2*b* and the cover portion 2*a*, resulting in the low-rigidity area P being pulled in the radial direction. As a result, even though its rigidity is small, the blade revolves as though it were a high-rigidity moving blade. Even if, for example, the moving blade 2 contacts peripheral parts or the stationary blade 3 when the moving blade is stopped, as a result of the low area P rigidity, it will become horizontal and will rotate without making contact due to the effect of centrifugal force when the moving blade 2 rotates. It is therefore not necessary as in the past to increase the rigidity of moving blade 2 or enlarge the moving blade 2 and its peripheral part spacing in order to avoid contact.

For the convenience of the reader, the above description has focused on a representative sample of all possible embodiments, a sample that teaches the principles of the invention and conveys the best mode contemplated for carrying it out. The description has not attempted to exhaustively enumerate all possible variations. Other undescribed variations or modifications may be possible. For example, where multiple alternative embodiments are described, in many cases it will be possible to combine elements of different embodiments, or to combine elements of the embodiments described here with other modifications or variations that are not expressly described. Many of those undescribed variations, modifications and variations are within the literal scope of the following claims, and others are equivalent.

We claim as follows:

1. A moving blade portion for use in a thin-form centrifugal fan comprising:

a base having a center portion and a peripheral portion; and a plurality of partitions extending perpendicularly from the peripheral portion of the base;

wherein a thickness of the peripheral portion of the base is greater than a thickness of the center portion of the base along the entire length of the partitions.

2. The moving blade portion according to claim 1, wherein the partitions are formed of a film-shaped metal foil.

3. The moving blade portion according to claim 1, wherein the partitions are formed of a synthetic resin.

4. A thin-form centrifugal fan having a moving blade portion, the moving blade portion comprising:

a base having a center portion and a peripheral portion; and a plurality of partitions extending perpendicularly from the peripheral portion of the base;

wherein a thickness of the peripheral portion of the base is greater than a thickness of the center portion of the base along the entire length of the partitions.

5. A thin-form centrifugal fan according to claim 4 wherein the partitions are formed of a film-shaped metal foil.

6. A thin-form centrifugal fan according to claim 4 wherein the partitions are formed of a synthetic resin.

7. A thin-form centrifugal fan comprising:

a first moving blade with a plurality of partitions;

a second moving blade with a plurality of partitions; and a stationary blade disposed between the first moving blade and the second moving blade and directing gas taken in by rotation of the first moving blade to the second moving blade, wherein the first and second moving blades are formed such that the rigidity of their central portions is smaller than the rigidity of their outer perimeter areas and the thickness of their outer perimeter areas is greater than a thickness of their center portions along the entire length of the partitions.

8. The thin-form centrifugal fan according to claim 7, wherein the partitions are formed of a film-shaped metal foil.

9. The thin-form centrifugal fan according to claim 7, wherein the partitions are formed of a synthetic resin.

* * * * *